US006439104B1

(12) United States Patent
Tonogai et al.

(10) Patent No.: US 6,439,104 B1
(45) Date of Patent: Aug. 27, 2002

(54) SMALL SIZE AIR PUMP

(75) Inventors: Yoshihide Tonogai; Shin Odajima; Masaaki Takagi, all of Tokyo (JP)

(73) Assignee: Nidec Copal Corporation, Tokyo (JP)

( * ) Notice: Subject to any disclaimer, the term of this patent is extended or adjusted under 35 U.S.C. 154(b) by 0 days.

(21) Appl. No.: 09/631,061

(22) Filed: Aug. 1, 2000

(30) Foreign Application Priority Data

Aug. 2, 1999 (JP) ..... 11-218698

(51) Int. Cl.[7] ..... F04B 37/14
(52) U.S. Cl. ..... 92/140; 92/136; 74/29
(58) Field of Search ..... 92/140, 136; 74/25, 74/29

(56) References Cited

U.S. PATENT DOCUMENTS 4,874,296 A 10/1989 Moynihan
5,127,808 A 7/1992 Nichols et al.
5,639,226 A 6/1997 Boutrup et al.
5,655,887 A * 8/1997 Chou ..... 417/63
5,782,204 A * 7/1998 Rahn ..... 119/255

* cited by examiner

*Primary Examiner*—Kevin Lee
(74) *Attorney, Agent, or Firm*—Beyer Weaver & Thomas, LLP

(57) ABSTRACT

The present invention aims at providing a small size air pump which has a simple structure and is less likely to incur restrictions on its space for installation and accommodation. The present invention provides a small size air pump 1 in which a motor 4 is driven to actuate a pump section 3, so as to carry out a predetermined aspirating operation; the air pump 1 comprising a worm gear 15 disposed at an output shaft 4*a* of the motor 4; a worm wheel 16, disposed between the motor 4 and the pump section 3, meshing with the worm gear 15; a smaller gear 18 disposed coaxial with the worm wheel 16; a larger gear 20, disposed at a position held between the motor 4 and the pump section 3, meshing with the smaller gear 18; and an actuator element 21 having one end pivotally connected to a periphery of a flat part 20*a* of the larger gear 20 and the other end connected to an end part of a piston 5 of the pump section 3.

3 Claims, 4 Drawing Sheets

SMALL SIZE AIR PUMP

BACKGROUND OF THE INVENTION

1. Field of the Invention

The present invention relates to a small size air pump which aspirates air from within a space occupied by a rotary member disposed in an instrument, thereby preventing air resistance in the rotary member, heat in the occupied space, and the like from occurring.

2. Related Background Art

An example of air pump structure is disclosed in WO 94/20755, U.S. Pat. No. 5.639.226. The air pump disclosed in this publication has a configuration for use in bicycles, in which the pump is actuated by a portable battery, such that a driving gear disposed at the output shaft of the motor and a crown gear mesh with each other, whereas the rear end of a piston rod is axially supported by the crown gear so as to axially support a cylinder itself in a swinging fashion. Due to such a configuration, the torque of motor is transmitted to the piston rod by way of a speed-reducing mechanism, so as to actuate the cylinder/piston pump.

SUMMARY OF THE INVENTION

The above-mentioned conventional air pump has a problem as follows. The speed-reducing mechanism based on a combination of the driving gear and crown gear, which is employed for compensating for output characteristics of the motor, is considered to be effective when there is sufficient room in the space for installing the air pump as in the case of a bicycle. However, the above-mentioned air pump has been problematic in that it is hard to utilize in a state where the apparatus incorporating the air pump is so small that the space for installing and accommodating the air space is quite limited.

In order to overcome the above-mentioned problem, it is an object of the present invention to provide a small size air pump which has a simple structure and is less likely to incur restrictions on its space for installation and accommodation.

The present invention provides a small size air pump in which a motor is driven to actuate a pump section, so as to carry out a predetermined aspirating operation; the air pump comprising a worm gear disposed at an output shaft of the motor; a worm wheel, disposed between the motor and the pump section, meshing with the worm gear; a smaller gear disposed coaxial with the worm wheel; a larger gear, disposed at a position held between the motor and the pump section, meshing with the smaller gear; and an actuator element having one end pivotally connected to a periphery of a flat part of the larger gear and the other end connected to an end part of a piston of the pump section.

In this small size air pump, the output of motor can reliably be transmitted to the worm wheel due to a cooperating action between the worm gear disposed at the output shaft and the worm wheel. Also, a combination of smaller and larger gears rotating in synchronization with the worm wheel can easily set the reduction ratio. Employing such a gear train in an air pump can easily deal with the space for installing and accommodating the air pump even when the space is quite limited. When a small size motor with a small rotational torque is utilized, a slight power transmission loss may greatly affect characteristics of the air pump, which makes it important to employ an appropriate power transmitting mechanism. In this sense, the above-mentioned gear train can be considered optimal.

Preferably, the small size air pump further comprises a support plate connecting the motor and the pump section to each other; a first axle part of the worm wheel and smaller gear and a second axle part of the larger gear being arranged in the support plate; the motor, the pump section, and the larger gear being disposed in series in an axial direction of the output shaft. When such a configuration is employed, the larger gear is appropriately disposed between the motor and the pump section, whereby the air pump can be made smaller.

Preferably, the motor, the pump section, and a speed-reducing mechanism disposed between the motor and the pump section occupy a volume of 5 $cm^3$ or less. Even under such a restriction of occupied volume, an air pump having a high compression ratio can be embodied.

Preferably, in the small size air pump, the motor has a barrel part having a volume of 5 $cm^3$ or less. Such a motor can be considered to be a small size motor which hardly takes up a space for accommodating it.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

In the following, a preferred embodiment of the small size air pump in accordance with the present invention will be explained with reference to the drawings.

Figure 1:
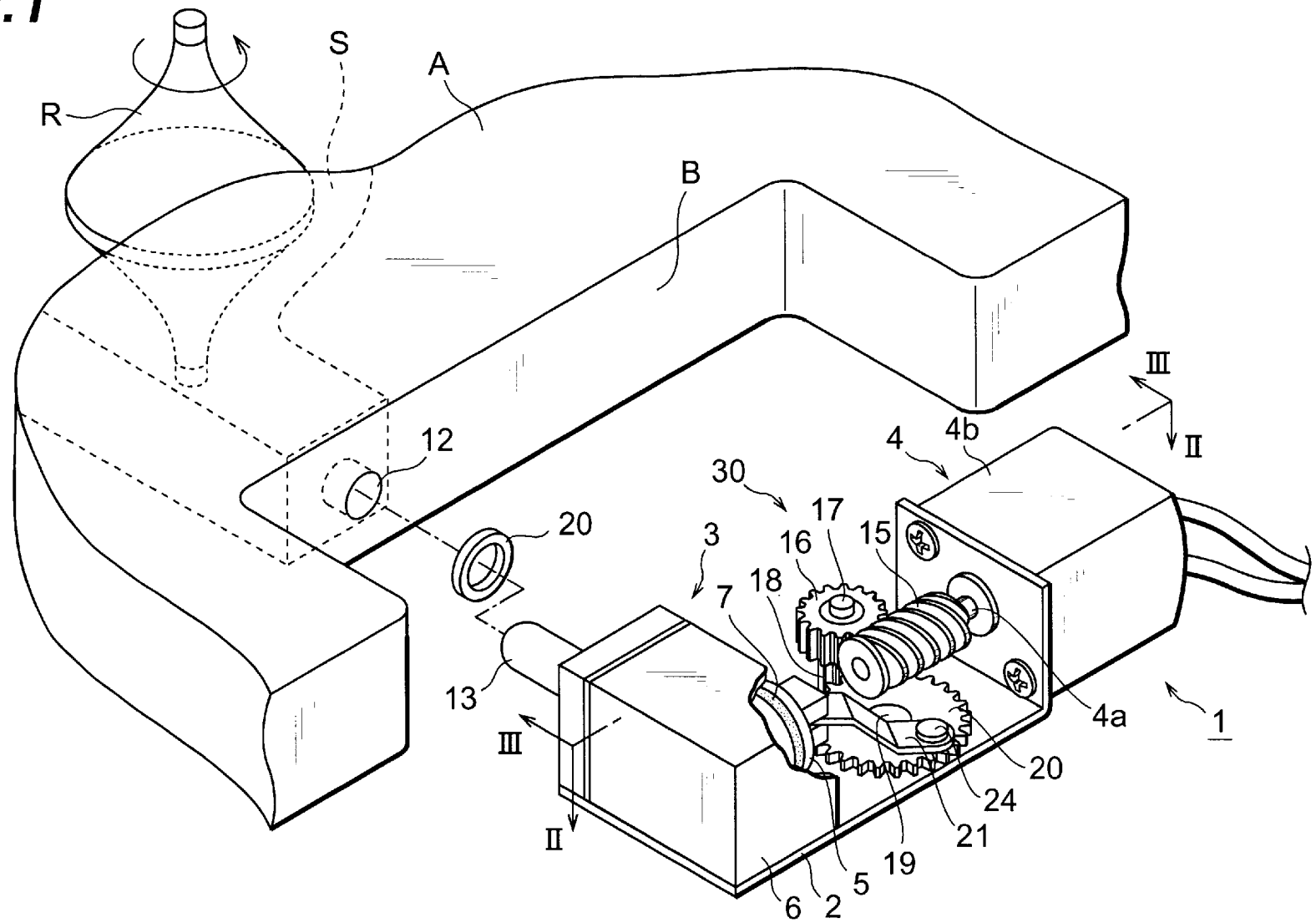
FIG. 1 is a perspective view showing an embodiment of the small size air pump in accordance with the present invention.
Figure 2:
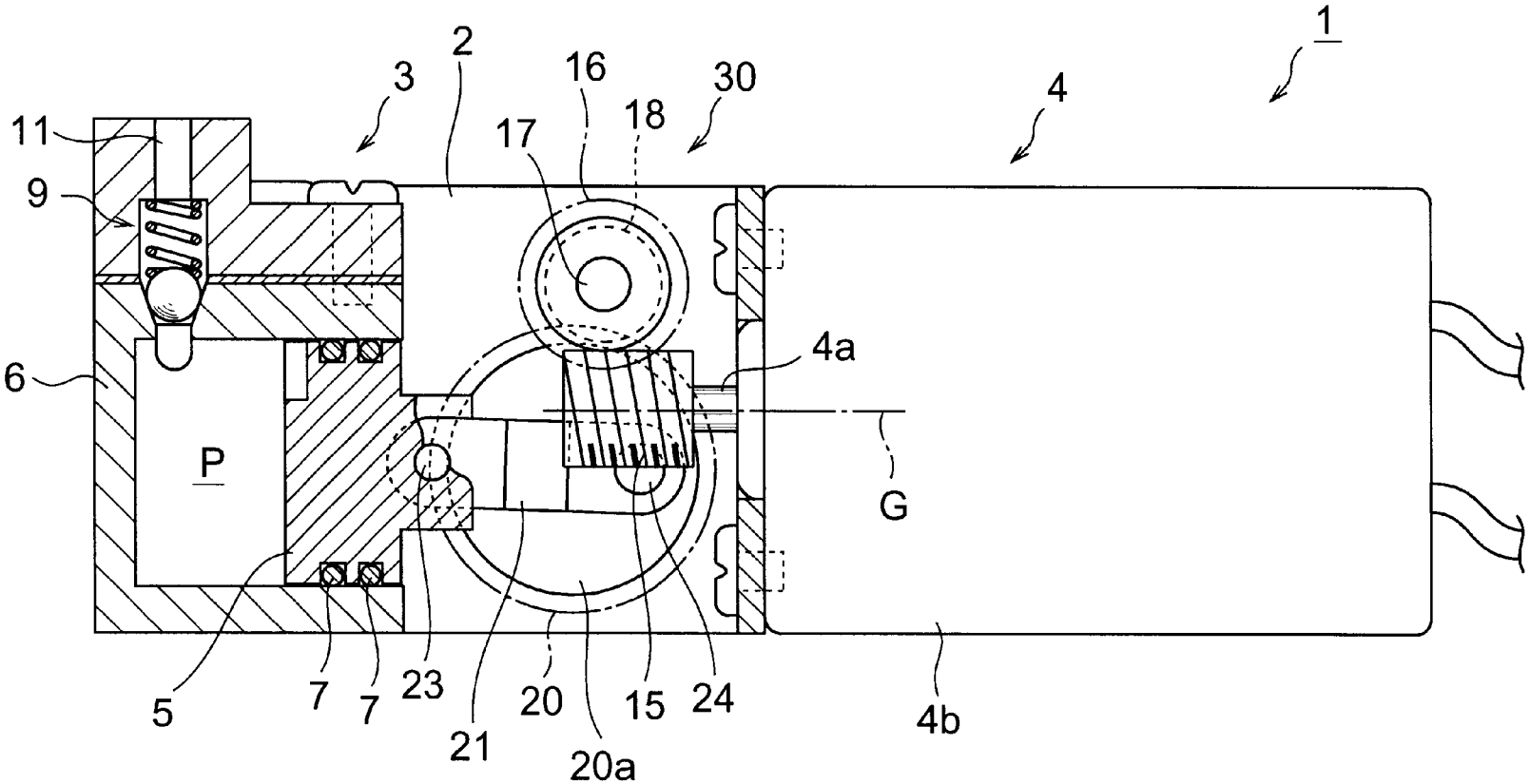
FIG. 2 is a sectional view taken along the line II—II of FIG. 1.
Figure 3:
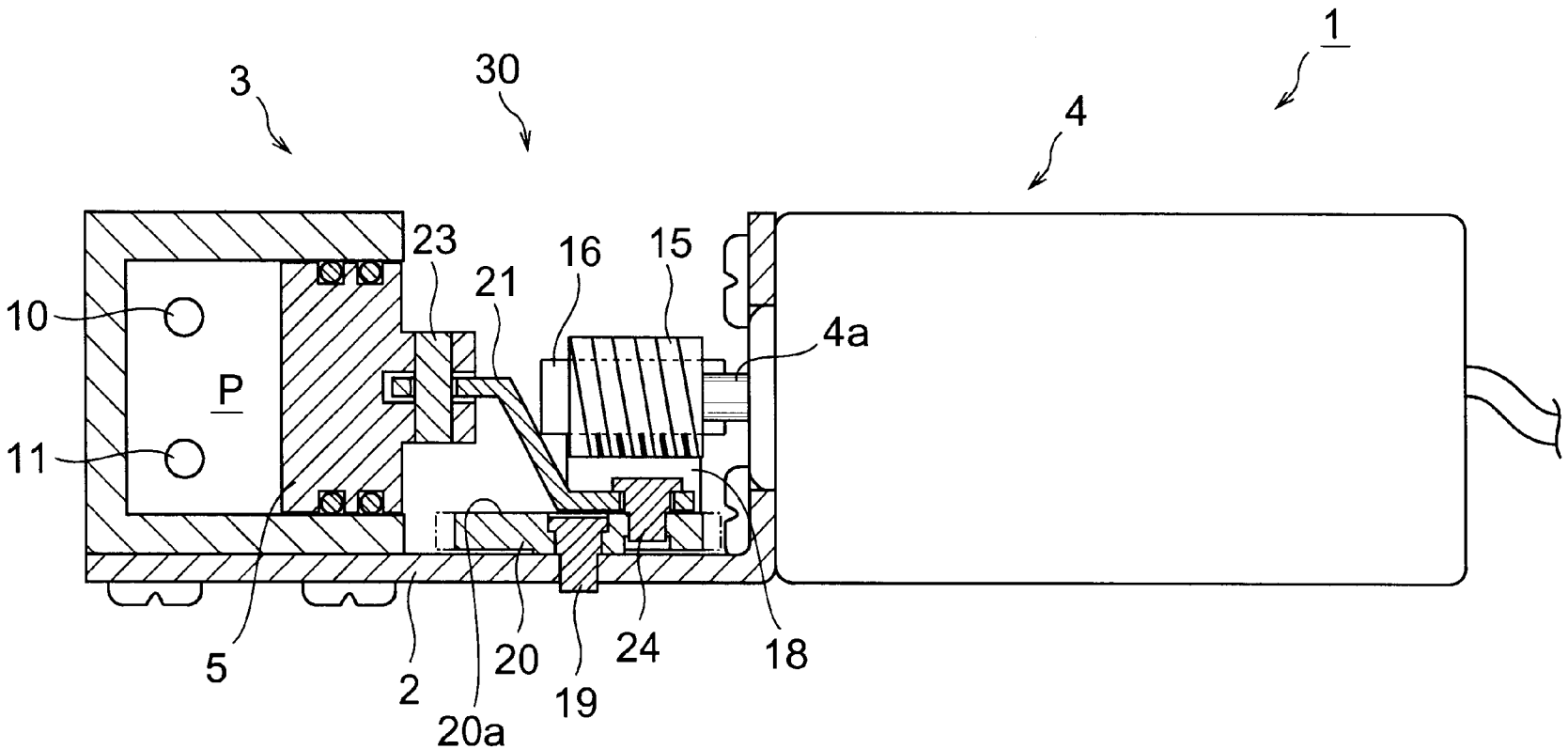
FIG. 3 is a sectional view taken along the line III—III of FIG. 1.

The air pump 1 shown in FIGS. 1 to 3 is quite small with a total length of about 30 mm, which can be considered very small in the category of air pump. This air pump 1 has a pump section 3 secured onto a support plate 2 with screws, a motor 4 secured to the support plate 2 with screws so as to face the pump section 3, and a speed-reducing mechanism 30 disposed on the support plate 2 so as to be placed between the pump section 3 and the motor 4. The volume occupied by the pump section 3, the motor 4, and the speed-reducing mechanism 30 is restricted to 3 to 5 $cm^3$or less in an instrument A, whereby the air pump 1 can be considered ultra-compact in this sense.

The pump section 3 employed in this air pump 1 is of a reciprocating type aimed at letting out the air from within the predetermined instrument A so as to reduce the pressure within the instrument A. The pump section 3 has a piston 5 reciprocating along the axis G of the output rod 4*a* of the motor 4 within a cylinder 6. A sealing member 7 is doubly fitted into the peripheral surface of the piston 5, so as to prevent the air from leaking when the piston 5 reciprocates at a high speed within the cylinder 6.

Figure 4:
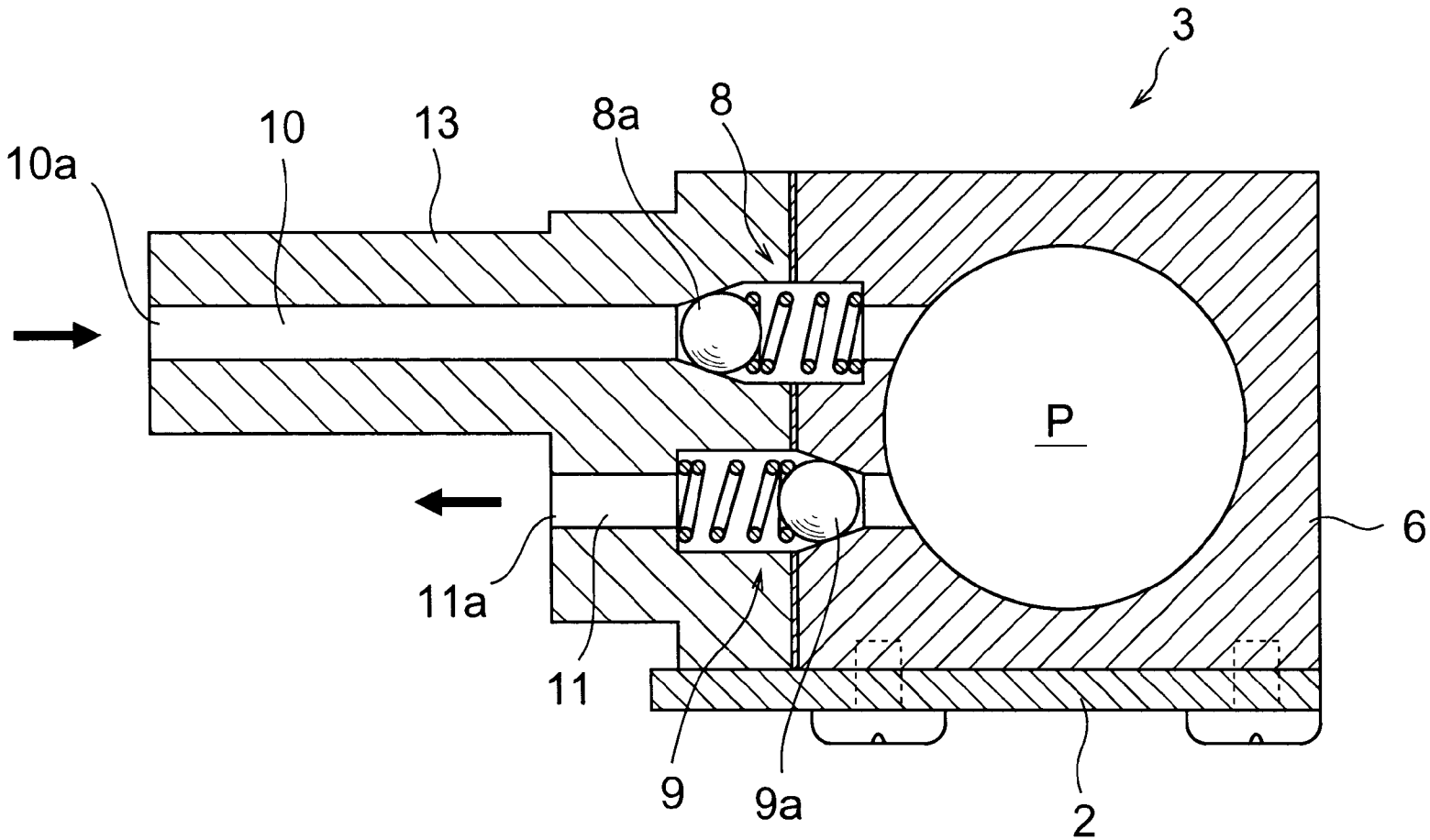
FIG. 4 is a sectional view showing a pump section.

Also, as shown in FIG. 4, the cylinder 6 is formed with an intake passage 10 and an exhaust passage 11 which extend in a direction orthogonal to the axis G. A predetermined occupied space S surrounding a rotary member R rotating at a high speed like a top within the instrument A and the cylinder 6 communicate with each other through an opening 12 (see FIG. 1). The intake passage 10 of the cylinder 6 is formed within a nozzle 13 inserted into the opening 12 by way of a rubber packing 22. The exhaust passage 11 opens into atmosphere. An intake valve 8 is disposed in the intake passage 10 on its way, whereas an exhaust valve 9 is disposed in the exhaust passage 11 on its way. Each valve 8, 9 is constructed as a check valve having a spring-urged ball 8*a*, 9*a*, and is operable at a differential pressure of about 0.1 atm between its inside and outside.

If the pump section 3 is constructed as such, and the piston 5 is reciprocated at a high speed by the motor 4, then air within a chamber P is let out from an exhaust port 11*a* by way of the exhaust valve 9, whereas air is introduced into the chamber P from an intake port 10*a* by way of the intake valve 8. As a consequence, air can continuously be drawn from the intake port 10*a* inserted into the occupied space S of the instrument A, whereby the pressure within the occupied space S of the instrument A is reduced.

The speed-reducing mechanism having a configuration such as that in the following is employed in order to enhance the aspirating capacity of the above-mentioned pump section 3 and make the air pump 1 compact by use of the small size motor 4 having a barrel part 5*b* with a volume of 5 $cm^3$ or less (e.g., about 2.5 $cm^3$) and thus occupying a small volume.

As shown in FIGS. 1 to 3, a worm gear 15 is secured to the output shaft 4*a* of the motor 4, and meshes with a worm wheel 16 disposed between the motor 4 and the pump section 3. The worm wheel 16 is pivotally attached to a first axle part 17 vertically disposed in the support plate 2. The first axle part 17 also supports a smaller wheel 18 made of a spur gear. In order to follow the rotation of the worm wheel 16, the smaller gear 18 is united with the worm wheel 16. Namely, the worm wheel 16 and the smaller gear 18 are stacked.

Further, a second axle part 19 is vertically disposed in the support plate 2 near the center thereof, whereas a larger gear 20 in mesh with the smaller gear 18 is rotatably attached to this axle part 19. Employing such a gear train allows the larger gear 20 having a large size to be accommodated between the motor 4 and the pump section 3 in the support plate 2. Also, the motor 4, the pump section 3, and the larger gear 20 can be arranged in series along the axis G of the output shaft 4*a*. As a consequence, the air pump 1 can be made compact.

Also, a crank mechanism is utilized as one converting the rotation of the larger gear 20 to the reciprocation of the piston 5. Specifically, the larger gear 20 and the piston 5 are linked to each other by a link bar 21 acting as an actuator element. One end of the link bar 21 is pivotally attached to the vicinity of the periphery of a flat part 20*a* of the larger gear 20 by way of a pin part 24, whereas the other end of the link bar 21 is pivotally attached to the end part of the piston 5 by way of a pin part 23. Employing such a crank mechanism can appropriately convert the rotary movement of the larger gear 20 into the reciprocation of the piston 5, while effectively utilizing the space between the motor 4 and the pump section 3.

As mentioned above, the output of the motor 4 can reliably be transmitted by the cooperating action between the worm gear 15 disposed at the output shaft 4*a* and the worm wheel 16. Also, a combination of the smaller gear 18 and larger gear 20 rotating in synchronization with the worm wheel 16 makes it easier to set the reduction ratio.

When the small size motor 4 with a small rotational torque is utilized, a slight power transmission loss may greatly affect characteristics of the air pump 1, which makes it important to employ an appropriate power transmitting mechanism. In this sense, the above-mentioned gear train is employed. Such a speed-reducing mechanism 30 is particularly effective in the case where a space B for installing and accommodating the air pump 1 is quite limited, e.g., in a very narrow space of 3 to5 $cm^3$.

Such a configuration of the air pump 1 can make it smaller so as to be accommodated within a rectangular parallelepiped space occupying a volume of 3 $cm^3$ or less (e.g., width of 10 mm×height of 8 mm×length of 30 mm), even when the pump section 3 attains a compression ratio of 7 or higher therein and the predetermined space S of the instrument A has a pressure of 0.3 atm or lower, whereby a large pressure-reducing effect can be achieved while in a small size.

The above-mentioned air pump 1 is applicable to various instruments as a matter of course. In particular, it is utilized for portable electric air pumps for bicycles attaining improved usability by using a battery as their power supply, relays aimed at preventing contacts from being oxidized and discharge from occurring due to decreases in humidity, electric appliances (such as OA machines in particular) avoiding heating by improving the windage of their rotary members, polygon mirror devices for laser printers aimed at reducing heating by improving the windage of their rotary members,and the like. Examples of the rotary member include a rotor rotating at a high speed within a motor; a cylindrical tube, cylindrical column, or disk rotating at a high speed within an instrument; and the like.

The present invention is not limited to the above-mentioned embodiment. For example, the air pump 1 may be accommodated within a rectangular parallelepiped housing in view of dust particles and the like within the instrument Due to the foregoing configuration, the small size air pump in accordance with the present invention attains the following effects. Namely, it is a small size air pump in which a motor is driven to actuate a pump section, so as to carry out a predetermined aspirating operation; the air pump comprising a worm gear disposed at an output shaft of the motor; a worm wheel, disposed between the motor and the pump section, meshing with the worm gear; a smaller gear disposed coaxial with the worm wheel; a larger gear, disposed at a position held between the motor and the pump section, meshing with the smaller gear; and an actuator element having one end pivotally connected to a periphery of a flat part of the larger gear and the other end connected to an end part of a piston of the pump section; whereby it has a simple structure and is less likely to incur restrictions on its space for installation and accommodation.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A small size air pump in which a motor is driven to actuate a pump section, so as to carry out a predetermined aspirating operation; said air pump comprising:

a worm gear disposed at an output shaft of said motor;

a worm wheel, disposed between said motor and said pump section, meshing with said worm gear;

a smaller gear disposed coaxial with said worm wheel;

a larger gear, disposed at a position held between said motor and said pump section, meshing with said smaller gear;

actuator element having one end pivotally connected to a periphery of a flat part of said larger gear and the other end connected to an end part of a piston of said pump section; and a support plate connecting said motor and said pump section to each other; and wherein a first axle part of said worm wheel and smaller gear and a second axle part of said larger gear are arranged in said support plate; and said motor, said pump section, and said larger gear are disposed in series in an axial direction of said output shaft.

2. A small size air pump according to claim 1, wherein said motor, said pump section, and a speed-reducing mechanism disposed between said motor and pump section occupy a volume of 5 $cm^3$ or less.

3. A small size air pump according to claim 1, wherein said motor has a barrel part having a volume of 5 $cm^3$ or less.

* * * * *